US005226835A

United States Patent [19]

Baker, III et al.

[11] Patent Number: 5,226,835

[45] Date of Patent: Jul. 13, 1993

[54] PATCH PLUG FOR CROSS-CONNECT EQUIPMENT

[75] Inventors: Frank P. Baker, III; Golam M. Choudhury, both of Chatham, N.J.; W. John Denkmann, Carmel; Willard A. Dix, Noblesville, both of Ind.; Lyndon D. Ensz, Omaha, Nebr.; William T. Spitz, Indianapolis, Ind.

[73] Assignee: AT&T Bell Laboratories, Murray Hill, N.J.

[21] Appl. No.: 925,142

[22] Filed: Aug. 6, 1992

[51] Int. Cl.[5] ..... H01R 4/24

[52] U.S. Cl. ..... 439/403

[58] Field of Search ..... 439/389–425, 439/676

[56] References Cited

U.S. PATENT DOCUMENTS 4,413,469 11/1983 Paquin ..... 57/293

4,831,497 5/1989 Webster et al. ..... 361/406

4,850,887 7/1989 Sugawara ..... 439/108

5,055,064 10/1991 Imaizumi et al. ..... 439/402

*Primary Examiner*—Joseph H. McGlynn

*Attorney, Agent, or Firm*—Michael A. Morra

[57] ABSTRACT

A plug for interconnecting a pair of wires at its input with a pair of insulation displacement connectors (IDC) at its output is improved. The plug comprises a dielectric housing and a pair of non-insulated conductors within the housing that cross over and are spaced-apart from each other. Each conductor comprises a generally flat blade portion for insertion into an IDC at one end, and a terminal for making electrical contact with a wire at the other. In the illustrative embodiment of the invention, the terminal comprises an insulation displacement connector. Additionally, the conductors are identical to each other, but are reverse-mounted with respect to each other to achieve crossover.

7 Claims, 5 Drawing Sheets

PATCH PLUG FOR CROSS-CONNECT EQUIPMENT

TECHNICAL FIELD

This invention relates to an electrical connector, and more particularly to an electrical plug having reduced crosstalk coupling between conductor-pairs within the plug and between plugs.

BACKGROUND OF THE INVENTION

Information flow has increased substantially in recent years, and networks have evolved to accommodate not only a greater number of users but also higher data rates. An example of a relatively high speed network is the subject of ANSI/IEEE Standard 802.5 which provides a description of the peer-to-peer protocol procedures that are defined for the transfer of information and control between any pair of Data Link Layer service access points on a 4 Mbit/s Local Area Network with token ring access. At such data rates, however, wiring paths themselves become antennae that both broadcast and receive electromagnetic radiation. Signal coupling (crosstalk) between different pairs of wires is a source of interference that degrades the ability to process incoming signals. This is manifested quantitatively as decreased signal-to-noise ratio and, ultimately, as increased error rate. Accordingly, crosstalk becomes an increasingly significant concern in electrical equipment design as the frequency of interfering signals is increased.

Crosstalk occurs not only in the cables that carry the data signals over long distances, but also in the connectors that are used in cross-connect panels. ANSI/IEEE Standard 802.5 discloses a Medium Interface Connector having acceptable crosstalk rejection at the frequencies of interest. This Connector features four signal contacts with a ground contact, and is hermaphroditic in design so that two identical units will mate when oriented 180 degrees with respect to each other. This Connector is available as IBM Part No. 8310574 or as Anixter Part No. 075849. Crosstalk rejection appears to result from short connector paths, ground shields, and the selection of particular terminals for each wire-pair. As might be expected, such connector arrangements are relatively expensive and represent a departure from conventional interconnection hardware. For example, in commercial building applications, large bundles of wire-pairs terminate in electrical panels comprising linear arrays of individual connectors such as AT&T's 110-type insulation-displacement connectors (IDC). Each IDC accommodates a single wire pressed between its opposing contact fingers, and is so compact that many can fit into a small area. One bundle may come from a telephone central office while another bundle comes from telephone equipment within the building. Interconnecting particular wires from one bundle with particular wires from another bundle is accomplished with a patchcord comprising a cord with a plug (patch plug) attached to each end. The cord includes one or more wire-pairs within a plastic jacket. The patch plugs include a number of contact blades that are designed to be pressed into an equal number of IDCs within an array thereof. While the 110-type IDCs have become extremely popular because of their cost and size, the plugs used to make electrical connection with them suffer from excessive crosstalk at high frequencies. In particular, EIA/TIA Commercial Building Standards specify a maximum crosstalk at frequencies of 16–100 MHz. In order to meet end-to-end crosstalk requirements, the plugs themselves can only contribute a fraction of the total allowable crosstalk between wire-pairs.

Accordingly, it is desirable to design a patch plug having reduced crosstalk between conductor-pairs within the patch plug and between adjacent patch plugs.

SUMMARY OF THE INVENTION

In accordance with the invention, a plug for interconnecting a pair of wires at its input with a pair of insulation displacement connectors (IDC) at its output is improved. The plug comprises a dielectric housing which includes a pair of non-insulated conductors that cross over and are spaced-apart from each other. Each conductor comprises a generally flat blade portion for making contact with the IDC at one end, and means for making electrical contact with a wire at the other.

In illustrative embodiments of the invention, the means for making electrical connection at the other end of each conductor comprises an insulation displacement connector. In one illustrative embodiment, the conductors are identical, but are reverse-mounted in the dielectric housing.

BRIEF DESCRIPTION OF THE DRAWING

The invention and its mode of operation will be more clearly understood from the following detailed description when read with the appended drawing in which.

DETAILED DESCRIPTION

Most communication systems transmit and receive electrical signals over wire-pairs rather than individual wires. Indeed, an electrical voltage is meaningless without a reference voltage—a person can't even get shocked unless part of his body is in contact with a reference voltage. Accordingly, the use of a pair of wires for electrical signal transmission is merely the practice of bringing along the reference voltage rather than relying on a local, fixed reference such as earth ground. Each wire in a wire-pair is capable of picking up electrical noise from noise sources such as lightning, radio and TV stations. However, noise pickup is more likely from nearby wires that run in the same general direction for long distances. This is known as crosstalk. Nevertheless, so long as each wire picks up the same noise, the voltage difference between the wires remains the same and the differential signal is unaffected. To assist each wire in picking up the same noise, the practice of twisting wire-pairs in various patterns emerged.

Modern commercial buildings include an abundance of communications equipment; not only are individual offices within the building equipped with telephones and fax machines, they now include computers that are interconnected with other computers through high speed communication networks. For ease of administration, apparatus for interconnecting such equipment (with each other and with outside networks) is centralized via interconnection (cross-connect) panels that serve the entire building or at least large portions thereof. Furthermore, increased competition has caused companies to continually improve their services by adding new equipment and upgrading old equipment. Unfortunately, new/upgraded equipment frequently operates at higher speeds (up to 100 Mbps) that existing interconnection apparatus was not designed to accommodate. AT&T's 110-type cross-connect panels are a source of good news to building owners who already have such equipment in place because it meets EIA/TIA Commercial Building Standards "Category 5" requirements. Indeed, the only missing link for full Category 5 compliance is a patch plug for making connections between cable terminations on the cross-connect panel itself. Before proceeding with the improved design of the patch plug, a brief discussion of the cross-connect panel is useful.

Figure 1:
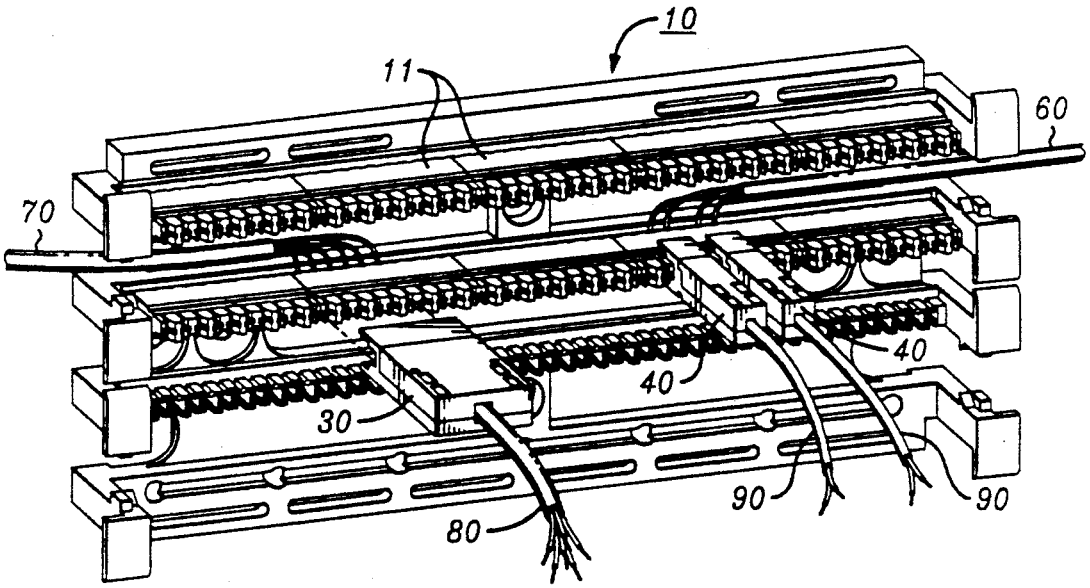
FIG. 1 discloses a cross-connect panel comprising an array of insulation displacement connectors, one end of which terminates building cables while the other end is adapted to be interconnected with patch plugs constructed in accordance with the invention.

FIG. 1 discloses a cross-connect panel 10 comprising an array of insulation displacement connectors (IDC) 11, one end of which terminates building cable 60 while the other end is adapted to be interconnected with other IDCs on the panel via patch plugs 30, 40. In addition to building cable 60, it is frequently necessary to terminate cable 70 from a location(s) outside the building. Panel 10 is shown having only a few connectors 11, although it is understood that larger panels exist and that many panels are co-located in a common bay. IDC 11 is a conventional 110-type connector that is commercially available from vendors such as AT&T that are designed to facilitate making mechanical and electrical connection to a wire—particularly a wire that is surrounded by dielectric insulation. The IDC includes a pair of opposing contact fingers that strip insulation from a wire that is pressed between the contact fingers so that an electrical contact is made between the wire and the IDC. The other end of IDC 11 is similarly constructed; however, instead of pressing individual wires between the contact fingers located therein, a patchcord may be connected. The patchcord comprises a cord 80 having a plug 30 on at least one end. As shown, plug 30 terminates a six-conductor cord 80 while plug 40 terminates a two-conductor cord 90. Cables 80, 90 exist that are designed for minimum crosstalk with nearby, adjacent cords—even when they are parallel and close together for long distances. However, within patch plug 30, and between patch plugs 40, crosstalk between wire-pairs represents a potential problem.

Prior Art

Figure 2:
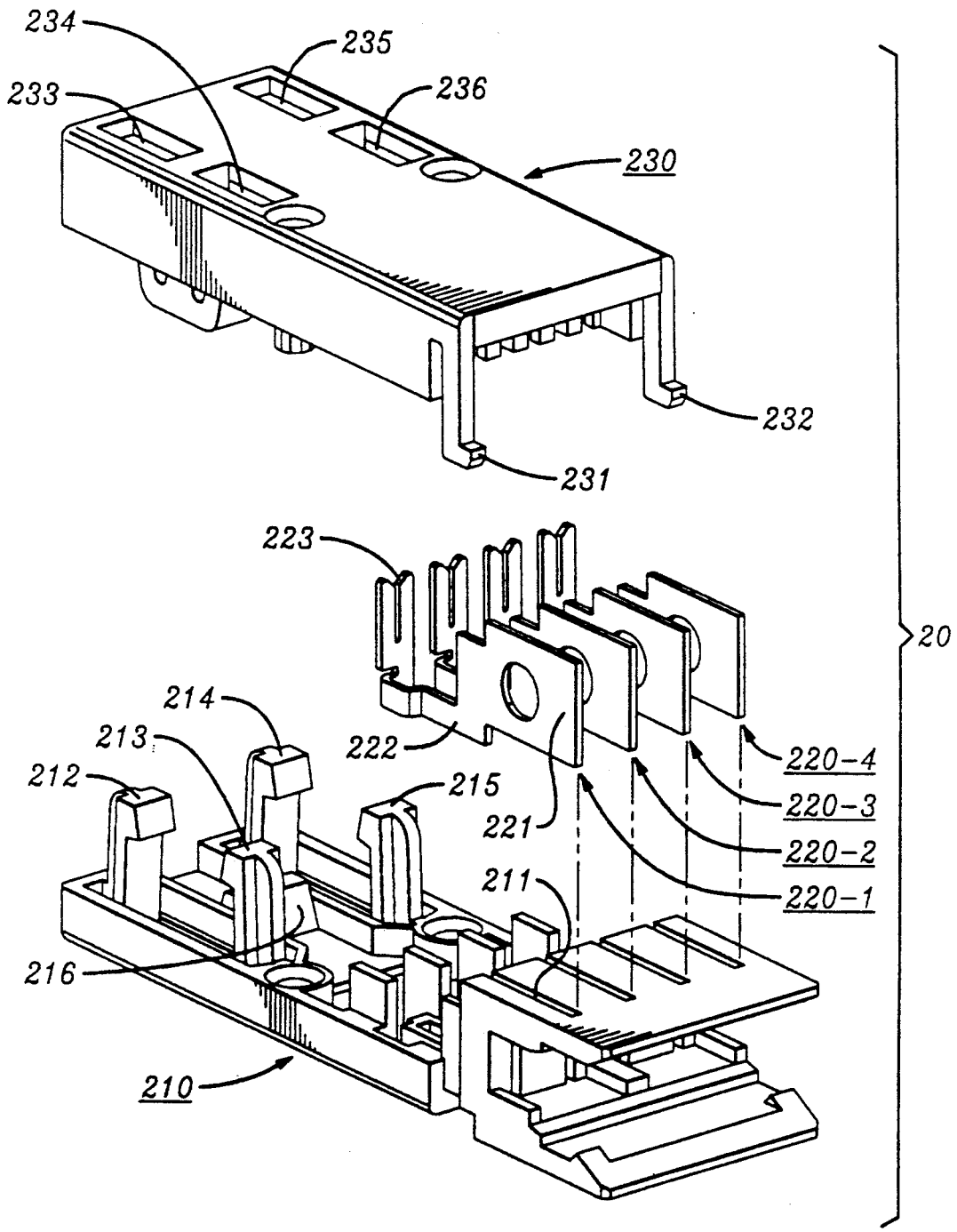
(PRIOR ART) FIG. 2
FIG. 2 discloses an exploded perspective view of a prior art patch plug.

FIG. 2 discloses a prior art 4-conductor patch plug 20 which does not meet EIA/TIA Category 5 requirements. The patch plug comprises a two-piece dielectric housing 210, 230 which snaps together and captures four conductors 220-1 through 220-4. Each of these conductors includes an insulation displacement connector 223 at one end for receiving individual wires from a cord; and a contact blade 221 at the other end for insertion into IDC 11 (shown in FIG. 1). Connecting these two ends is body portion 222 which is shaped for insertion into the lower dielectric housing 210. It is noted that individual wire pairs are conventionally located adjacent to each other; which is to say that conductors 220-1, 220-2 are associated with one wire-pair while conductors 220-3, 220-4 are associated with another wire-pair. Crosstalk between these pairs (caused particularly by conductors 220-2 and 220-3) is unacceptably high at data rates of 100 Mbps.

Lower housing member 210 is a plastic part that is molded, for example, from LEXAN® material—a polycarbonate resin. The lower housing member includes four slots 211 therein for receiving conductors 220-1 through 220-4. The conductors are factory-installed and firmly embedded in the lower housing. The lower housing member is designed such that patchcords of customized length can be quickly assembled by technicians on site. Cords comprising a plurality of insulated wires, surrounded by an insulating jacket (typically PVC), are prepared for connection to the conductors within the lower housing member 210 by stripping away a small portion of the jacket to expose the insulated wires—illustratively, 24 gauge stranded copper wires. For ease of assembly, the insulated wires are placed into the underside of upper housing member 230 which includes narrow channels for holding the wires in fixed positions. Thereafter, the upper housing member 230 is snapped onto the lower housing member 210 by pressing them together; and the wires are collectively pressed/seated into the insulation displacement connectors 223 of conductors 220-1 to 220-4. Additionally, hooks 231–232 and 212–215, that are molded into the housing members, mate with latches (not shown) to hold the housing members together. Openings 233–236 exist merely to simplify the molding tool which forms latches in the upper housing member 230. Similar openings exist in the bottom of the lower housing member 210 to simplify the molding tool which forms hooks 212–215. Strain relief for the cord (not shown) is provided by block 216 which presses the cord tightly against the upper housing member to relieve strain from the individual wire connections when the cord is pulled.

A Novel Patch Plug

Figure 3:
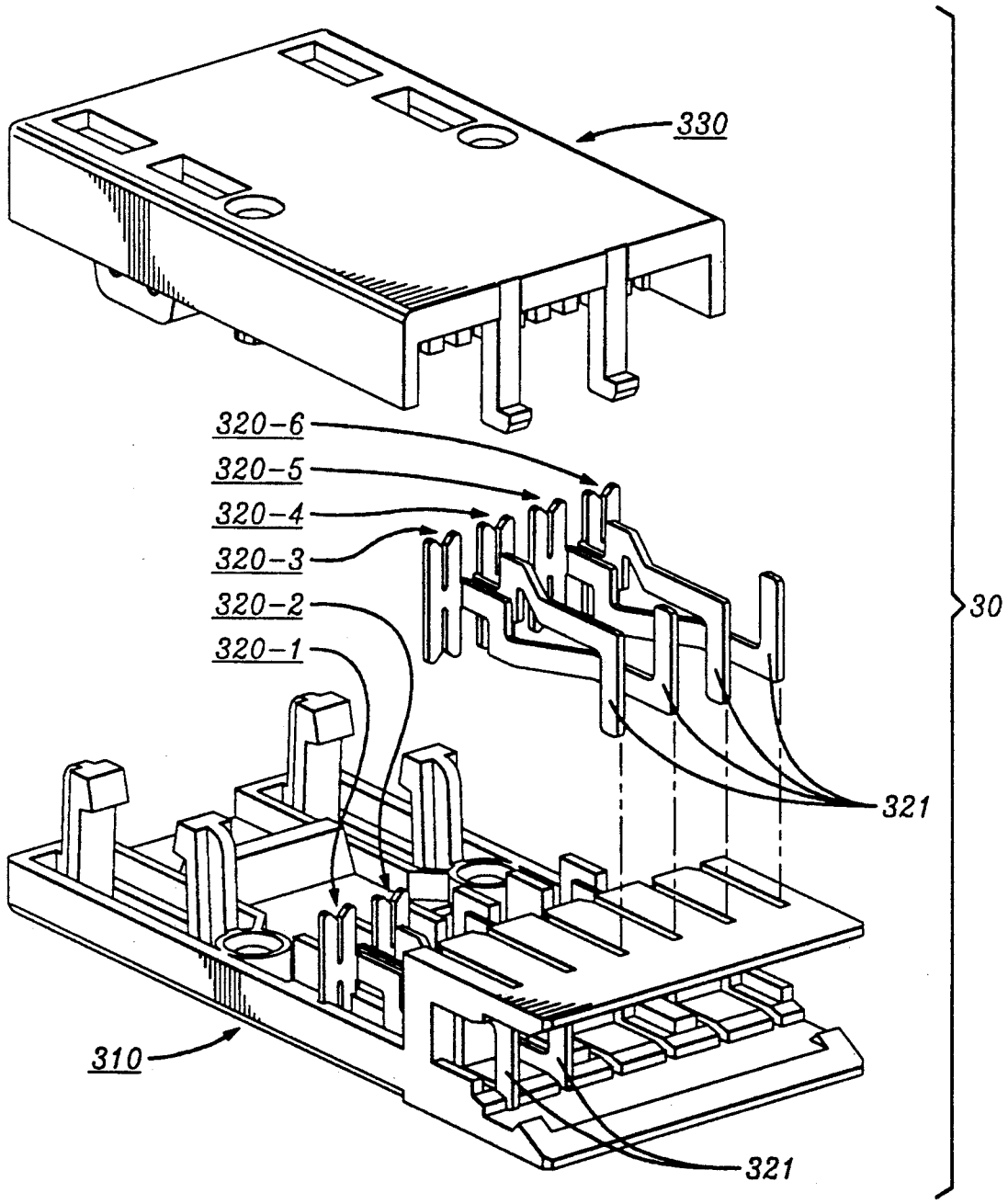
FIG. 3 discloses an exploded perspective view of a 3-pair patch plug designed in accordance with the present invention.

FIG. 3 discloses an exploded perspective view of a patch plug 30, in accordance with the present invention, showing its assembly in detail. Patch plug 30 is similar in construction to the prior art patch plug 20 shown in FIG. 2. However, the conductors are redesigned in such a manner that the crosstalk between adjacent pairs of conductors is reduced by 8 to 9 dB over the prior art patch plug shown in FIG. 2. Such an improvement is sufficient to meet EIA/TIA Category 5 requirements. In accordance with the invention, crosstalk reduction (within a single patch plug and/or between pairs of patch plugs) is accomplished by crossing over conductor-pairs within the patch plug—each conductor-pair being associated with an input wire-pair, thereby improving capacitive balance. Crosstalk reduction is further improved by minimizing the surface area of the contact blades 321. The patch plug shown in FIG. 3 comprises upper housing member 330 which is joined together with lower housing member 310 in the manner disclosed in connection with the prior art FIG. 2. The lower housing member is designed to contain the electrical conductors and hold them aligned in predetermined positions. In accordance with the present invention, conductor-pairs (320-1, 320-2), (320-3, 320-4) and (320-5, 320-6) are configured to substantially reduce crosstalk between each other. Input wires connect to the conductors using the insulation displacement connector at one end of the conductor. These input wires usually come in pairs that are twisted together to minimize crosstalk with nearby wires. The present invention adds a controlled half twist to each input wire-pair which, heretofore, has not been considered necessary. Furthermore, this is carried out in substantially the same patch plug housing as the prior art so that it is fully compatible with existing cross-connect panels. In the disclosed embodiment, the conductors are identical to each other and are crossed by mounting adjacent ones upside down. This provides the advantage of reducing the number of different parts needed for the patch plug. It is also possible to design two different conductors in order to further minimize the crosstalk the conductor-pairs or improve structural integrity. Nevertheless, to achieve the benefits of the present invention, these conductors must be paired together and include a half twist between their input and output terminals.

Figure 4:
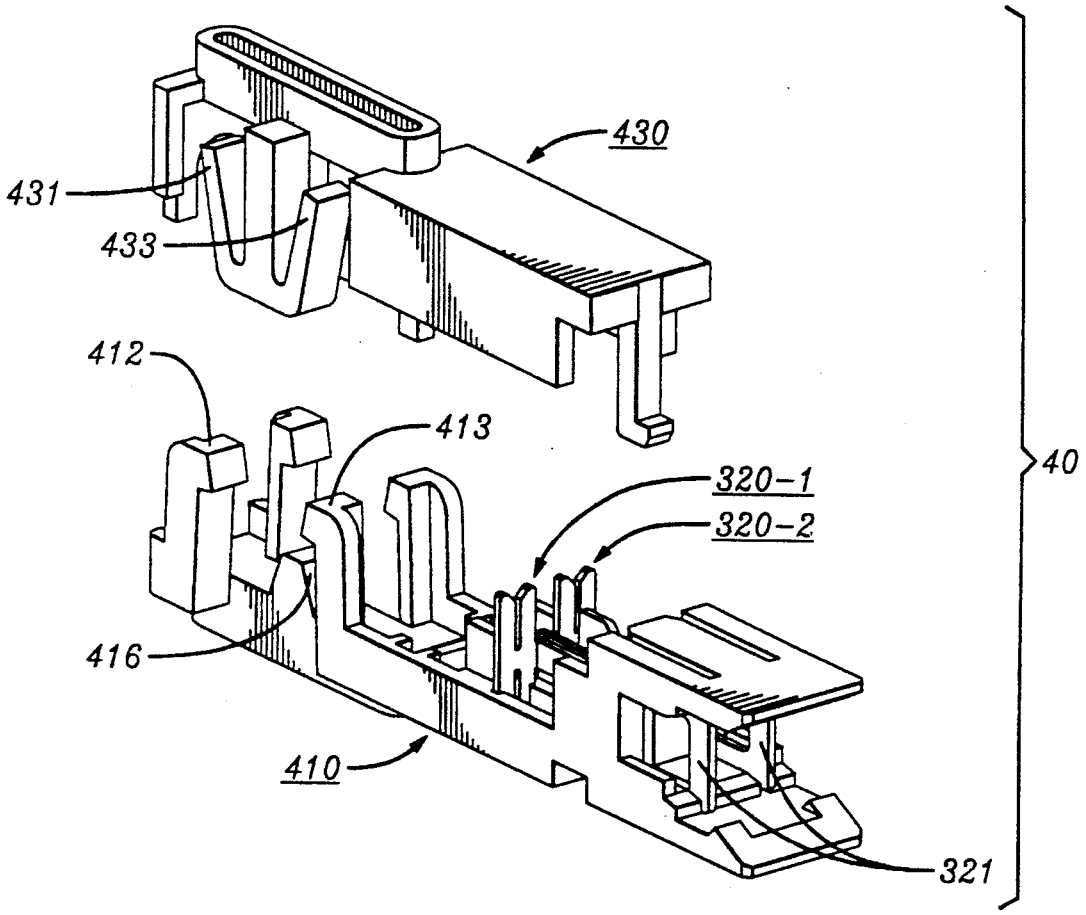
FIG. 4 discloses an exploded perspective view of a 1-pair patch plug designed in accordance with the present invention.

Whereas FIG. 3 discloses a patch plug having three conductor-pairs, FIG. 4 discloses a patch plug 40, in accordance with the invention, having only one conductor-pair. Such a plug is desirable because it is frequently mounted adjacent to another patch plug as, for example, shown in FIG. 1. The patch plug shown in FIG. 4 includes upper housing member 430 which snaps into lower housing member 410. Illustratively, hooks 412, 413 interconnect with latches 431, 433 during assembly. This hook and latch assembly is the same as used in connection with FIG. 2 and 3, but shown in greater detail here. Conductor-pair 320-1, 320-2 is shown already inserted into the lower housing member 410. These conductors terminate in contact blades 321 which are shown positioned for insertion into an IDC 11 of cross-connect panel 10 (see FIG. 1). Strain relief block 416 cooperates with the interior of upper housing member 430 to hold wires within the patch plug 40. The specific structure of conductor 320 is disclosed in greater detail in FIGS. 5-7.

Figure 5:
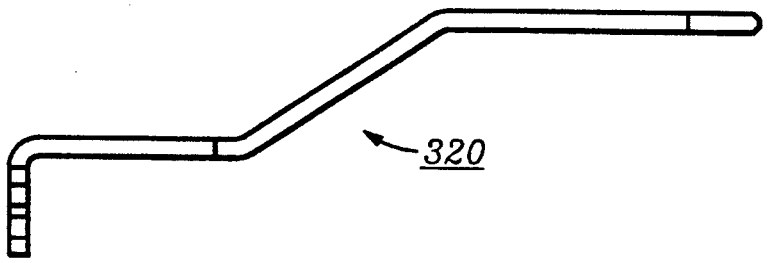
FIG. 5 is a top view of a conductor for a patch plug in accordance with the invention.

FIG. 5 discloses a top view of conductor 320 in accordance with the present invention. The conductor is fabricated from 0.016 inch-thick metal stock such as phosphor bronze and is approximately 0.65 inches long.

Figure 6:
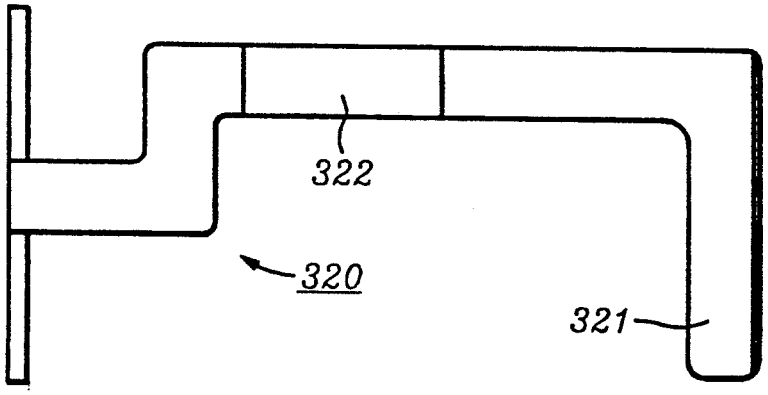
FIG. 6 is a side view of the conductor shown in FIG. 5.

FIG. 6 discloses a side view of the conductor shown in FIG. 5. Contact blade 321 is the portion of conductor 320 that inserts into a pair of contact fingers of IDC 11 shown in FIG. 1. The contact blade is, illustratively, 0.06 inches wide and 0.29 inches long.

Figure 7:
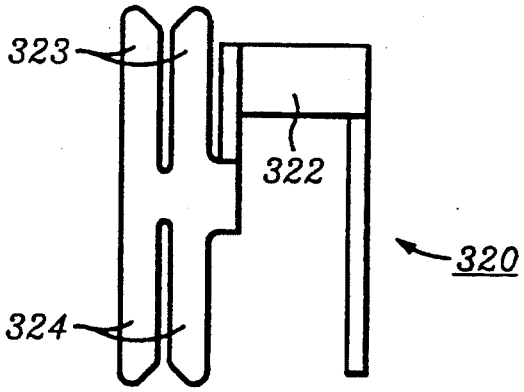
FIG. 7 is an end view of the conductor shown in FIG. 6.

FIG. 7 is an end view of the conductor shown in FIG. 6 showing the design of the insulation displacement terminal portion of conductor 320. It is noted that this particular design is reversible in that either contact fingers 323 or contact fingers 324 may be used to receive wires pressed between them—depending on which pair of contact fingers is facing upward. When a pair of conductors 320 are adjacent to each other, and mounted in opposite orientations, body portions 322 can be arranged to cross over each other as required in the present invention.

Although a particular embodiment of the invention has been shown and described, various modifications are possible within the spirit and scope of the invention. In particular, it is understood that the actual shape of the conductors is a matter of design choice, and that conductors that can be reversibly mounted are not required.

We claim:

1. Apparatus for interconnecting a pair of wires at its input with a pair of insulation displacement connectors at its output including a dielectric housing and a pair of non-insulated conductors within the housing that cross over and are spaced-apart from each other, each conductor comprising a generally flat blade portion at one end, and a terminal for making electrical contact with a wire at the other; whereby crosstalk between conductors is minimized.

2. The apparatus of claim 1 wherein the conductors are identical to each other, but mounted in reverse orientation with respect to each other within the dielectric housing to achieve crossover.

3. The apparatus of claim 1 wherein the terminal for making electrical contact with the wire comprises an insulation displacement connector.

4. The apparatus of claim 3 wherein the conductors are identical to each other, but mounted in reverse orientation with respect to each other within the dielectric housing to thereby achieve crossover.

5. A patchcord for making interconnection between pairs of insulation displacement connectors, the patchcord comprising a length of cord terminated in a plug at one end thereof, the cord comprising:

at least one pair of insulated copper wires that are twisted around each other a plurality of times over the length of the cord; and a dielectric jacket surrounding the pair of insulated copper wires, the plug comprising:

a dielectric housing including an upper member and a lower member that interlock together; and at least one pair of non-insulated conductors within the housing that cross over and are spaced-apart from each other, each conductor comprising a generally flat blade portion at one end and a terminal for making electrical contact with one of the insulated copper wires from the cord at the other.

6. A patch plug for connection to a plurality of first insulation displacement connectors comprising:

a plurality of spaced-apart electrical conductors, each being terminated in a second insulation displacement connector at one end and a contact blade at the other end, said contact blade being adapted for insertion into one of said first insulation displacement connectors, each conductor being paired with another conductor by a single crossover between same; and a dielectric housing containing the plurality of electrical conductors and maintaining the conductors aligned in predetermined positions.

7. The patch plug of claim 6 wherein the dielectric housing comprises a dielectric upper housing member interlocked with a dielectric lower housing member to provide a unitary structure.

* * * * *